US009562299B2

(12) United States Patent
Park et al.

(10) Patent No.: US 9,562,299 B2
(45) Date of Patent: Feb. 7, 2017

(54) COPPER ELECTROPLATING SOLUTION AND COPPER ELECTROPLATING APPARATUS

(71) Applicant: Samsung Electronics Co., Ltd., Suwon-Si, Gyeonggi-Do (KR)

(72) Inventors: Myung-Beom Park, Hwaseong-si (KR); Yun-Deok Kang, Hwaseong-si (KR); Ki-Hyeon Kim, Seoul (KR); Youn-Joung Cho, Hwaseong-si (KR); Jung-Sik Choi, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 336 days.

(21) Appl. No.: 14/155,776

(22) Filed: Jan. 15, 2014

(65) Prior Publication Data

US 2014/0197038 A1 Jul. 17, 2014

(30) Foreign Application Priority Data

Jan. 16, 2013 (KR) ..... 10-2013-0004909

(51) Int. Cl.

| | |
|---|---|
| ***C25D 5/02*** | (2006.01) |
| ***C25D 3/38*** | (2006.01) |
| ***C25D 5/04*** | (2006.01) |
| ***C25D 5/08*** | (2006.01) |
| ***C25D 17/00*** | (2006.01) |
| ***C25D 17/06*** | (2006.01) |
| ***C25D 21/14*** | (2006.01) |

(52) U.S. Cl.

CPC . *C25D 3/38* (2013.01); *C25D 5/04* (2013.01); *C25D 5/08* (2013.01); *C25D 17/001* (2013.01); *C25D 17/06* (2013.01); *C25D 21/14* (2013.01)

(58) Field of Classification Search

CPC ..... C25D 3/38; C25D 5/02; C25D 7/12; C25D 7/123

USPC ..... 205/123, 296, 297, 298

See application file for complete search history.

(56) References Cited

U.S. PATENT DOCUMENTS

| | | | | |
|---|---|---|---|---|
| 5,200,057 | A * | 4/1993 | Canaris | C25D 3/22 106/1.17 |
| 8,048,284 | B2 | 11/2011 | Reddington et al. | |
| 2004/0217009 | A1 | 11/2004 | Mikkola et al. | |
| 2010/0084277 | A1 | 4/2010 | Park et al. | |
| 2010/0219081 | A1 * | 9/2010 | Isono | C25D 3/38 205/291 |
| 2011/0220512 | A1 | 9/2011 | Niazimbetova et al. | |

(Continued)

FOREIGN PATENT DOCUMENTS

| | | | | |
|---|---|---|---|---|
| DE | 159268 | A3 * | 3/1983 | C25D 3/38 |
| JP | 2004-250777 | A | 9/2004 | |

(Continued)

*Primary Examiner* — Edna Wong

(74) *Attorney, Agent, or Firm* — Harness, Dickey & Pierce, P.L.C.

(57) ABSTRACT

An electroplating solution includes an aqueous electrolyte solution including water soluble copper salts, sulfide ions and chloride ions, an accelerator including an organic material having sulfur (S), the accelerator accelerating copper (Cu) reduction, a suppressor including a polyether compound, the suppressor selectively suppressing the copper reduction, and a leveler including a water soluble polymer having nitrogen that is dissolved into positive ions in the aqueous electrolyte solution.

9 Claims, 6 Drawing Sheets

(56) References Cited

U.S. PATENT DOCUMENTS

2011/0220514 A1 9/2011 Niazimbetova

FOREIGN PATENT DOCUMENTS

| | | | | | |
|---|---|---|---|---|---|
| JP | 2007332447 | A | * | 12/2007 | ..... C25D 3/38 |
| JP | 2010255078 | A | * | 11/2010 | ..... C25D 3/38 |
| JP | 2011-006773 | A | | 1/2011 | |
| KR | 2010-0017562 | A | | 2/2010 | |

* cited by examiner

COPPER ELECTROPLATING SOLUTION AND COPPER ELECTROPLATING APPARATUS

CROSS-REFERENCE TO RELATED APPLICATIONS

This application claims the benefit of Korean Patent Application No. 10-2013-0004909 filed on Jan. 16, 2013 in the Korean Intellectual Property Office, the disclosure of which is incorporated herein in its entirety by reference.

BACKGROUND

1. Field

Example embodiments relate to a copper electroplating solution, a copper electroplating apparatus and a method of forming a copper bump using the electroplating apparatus. More particularly, example embodiments relate to a copper electroplating solution and a copper electroplating apparatus for forming a bump on a flip chip and a method of forming the bump using the copper electroplating apparatus.

2. Description of the Related Art

Conventional semiconductor packages and board structure for a semiconductor package, for example, a printed circuit board (PCB), usually have contact terminals for electrically communicating with external bodies. For example, solder bumps and solder balls have been mainly used for the contact terminals of the packages and the board structures. Thus, the manufacturing efficiency of the packages and the board structures is influenced by the process efficiency of forming the contact terminals on the packages and the board structures.

Particularly, a chip scaled package (CSP), which has been widely used as a mini package for recent smaller-sized electronic systems, is manufactured by bonding the solder bumps to integrated circuit (IC) chips that are arranged on a semiconductor substrate, for example, a wafer. For example, the solder bump bonded to an active face of the IC chip makes contact with the contact pad of the PCB, and thus the IC chip and the PCB are manufactured into a flip chip package.

In general, the solder bump of the flip chip package is formed on the IC chip through a coating process and a reflow process. Conductive metals, for example, copper (Cu), nickel (Ni) and tin alloys (e.g., SnPb and SnAg), are coated on the electrode pads of the IC chip by an electroplating process and the coated metal layer is bonded to the electrode pad by a reflow process. Various electroplating solutions have been suggested for improving the uniformity of the solder bump by uniform metal plating and suggested for increasing the electroplating speed onto the electrode pad of the IC chip.

However, the uniformity of the solder bump and the uniform metal plating usually conflicts with the electroplating speed, and thus the uniform metal plating and the plating speed has trade-off relations. The plating speed is proportional to the intensity of the applied electrical current, and thus a larger current is required for a higher plating speed. In contrast, the current of relatively high intensity in the electroplating process usually causes locally abnormal growth of the electroplated metal and the non-uniform metal plating, which results in the non-uniformity of the solder bump. When the electrical current is applied to the IC chip at a relatively high intensity, the metal plating is likely to be performed locally under an unsteady state and thus the metal is excessively plated at some points and is insufficiently plated at other points. Therefore, the surface flatness of the solder bump is deteriorated and thus the surface area with which external bodies make contact is insufficient for the semiconductor package.

Particularly, various electroplating solutions have been suggested for copper (Cu) because copper (Cu) has been most widely used for the electroplating process for the solder bump. However, an electroplating solution of which the metal can be uniformly plated at a relatively high speed has not yet been suggested, especially for the electroplating metal of copper (Cu).

SUMMARY

Example embodiments of the present inventive concepts provide a copper electroplating solution for the copper bump of which the electroplating speed is sufficiently high without any deterioration of the surface flatness of the copper bump.

Example embodiments of the present inventive concepts provide a copper electroplating apparatus for forming the copper bump using the above copper electroplating solution.

Example embodiments of the present inventive concepts provide a method of forming the copper bump using the above copper electroplating apparatus.

According to example embodiments, an electroplating solution includes an aqueous electrolyte solution including water soluble copper salts, sulfide ions and chloride ions, an accelerator including an organic material having sulfur (S), the accelerator accelerating copper (Cu) reduction, a suppressor including a polyether compound, the suppressor selectively suppressing the copper reduction, and a leveler including a water soluble polymer having nitrogen that is dissolved into positive ions in the aqueous electrolyte solution.

In example embodiments, the aqueous electrolyte solution may include copper ions at a concentration of 10 g/L to 200 g/L, the sulfide ions at a concentration of 5 g/L to 50 g/L and the chloride ions at a concentration of 10 mg/L to 100 mg/L in the electroplating solution.

In example embodiments, the leveler may include one of an N-vinyl pyrrolidone compound represented by Chemical Formula (1), a diallyldimethyl ammonium chloride (DADMAC) represented by Chemical Formula (2) and a copolymer of DADMAC and N-vinyl pyrrolidone represented by Chemical Formula (3) at a concentration of 0.1 g/L to 10 g/L in the electroplating solution, (1)

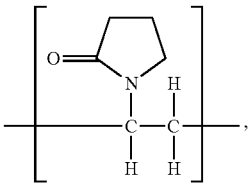

(2)

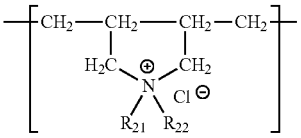

-continued (3)

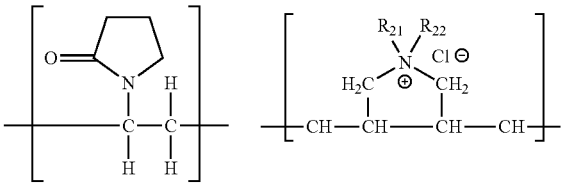

wherein each of R21 and R22 denote a $C_1$-$C_4$ unsubstituted alkyl group.

In example embodiments, the leveler may include a copolymer of the N-vinyl pyrrolidone compound represented by Chemical Formula (1), the diallyldimethyl ammonium chloride (DADMAC) represented by Chemical Formula (2) and the copolymer of DADMAC and N-vinyl pyrrolidone represented by Chemical Formula (3).

In example embodiments, the accelerator may include a disulfide compound represented by Chemical Formula (4), (4)

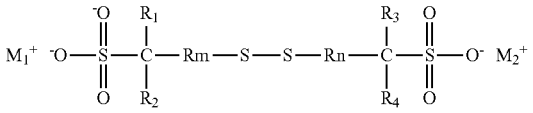

wherein each of $R_1$ and $R_3$ may independently represent one of a methyl group, an ethyl group, a propyl group, an isopropyl group, an n-butyl group, a sec-butyl group, a tert-butyl group and a trimethylsilyl group, each of $R_2$ and $R_4$ may independently represent one of hydrogen (H), a methyl group, an ethyl group, a propyl group, an n-butyl group, a sec-butyl group, a tert-butyl group and a trimethylsilyl group, each of Rm and Rn may independently represent one of a $C_1$-$C_{10}$ alkylene, a $C_3$-$C_{10}$ cycloalkylene and a $C_4$-$C_{10}$ aromatic hydrocarbon, and each of $M_1^+$ and $M_2^+$ may independently represent one of a proton, an alkali metal ion and an ammonium ion, and the suppressor may include a tri-block copolymer of polyethylene oxide (PEO)-polypropylene oxide (PPO)-PEO having a weight average molecular weight of 300 to 10,000 and having an ethylene oxide content (EO %) of 1% to 99% (w/w).

According to example embodiments, a copper electroplating apparatus for electroplating copper on a substrate includes a plating chamber containing an electroplating solution, a dispersion plate uniformly dispersing the electroplating solution in the plating chamber and providing copper ions to the electroplating solution, a substrate holder electrically connected to the dispersion plate and to which a substrate is secured, and a solution provider providing the electroplating solution into the plating chamber. The copper electroplating solution may include an aqueous electrolyte solution having water soluble copper salts, sulfide ions and chloride ions, an accelerator having an organic material having sulfur (S), the accelerator accelerating copper (Cu) reduction, a suppressor having a polyether compound, the suppressor selectively suppressing the copper reduction, and a leveler including a water soluble polymer having nitrogen that may be dissolved into positive ions in the aqueous electrolyte solution.

In example embodiments, the aqueous electrolyte solution may include copper ions at a concentration of 10 g/L to 200 g/L, the sulfide ions at a concentration of 5 g/L to 50 g/L and the chloride ions at a concentration of 10 mg/L to 100 mg/L in the electroplating solution. The leveler may include one of an N-vinyl pyrrolidone compound represented by Chemical Formula (1), a diallyldimethyl ammonium chloride (DADMAC) represented by Chemical Formula (2) and a copolymer of DADMAC and N-vinyl pyrrolidone represented by Chemical Formula (3) at a concentration of 0.1 g/L to 10 g/L in the electroplating solution, (1)

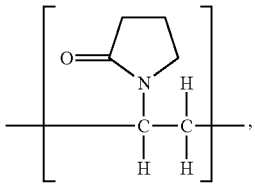

(2)

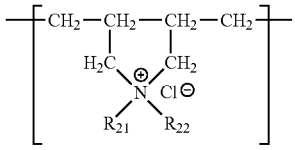

(3)

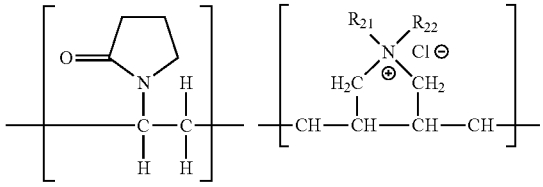

wherein each of $R_{21}$ and $R_{22}$ denote a $C_1$-$C_4$ unsubstituted alkyl group. The accelerator may include a disulfide compound represented by Chemical Formula (4):

(4)

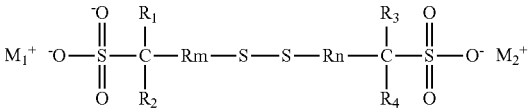

wherein each of $R_1$ and $R_3$ may independently represent one of a methyl group, an ethyl group, a propyl group, an isopropyl group, an n-butyl group, a sec-butyl group, a tert-butyl group and a trimethylsilyl group, each of $R_2$ and $R_4$ may independently represent one of hydrogen (H), a methyl group, an ethyl group, a propyl group, an n-butyl group, a sec-butyl group, a tert-butyl group and a trimethylsilyl group, each of Rm and Rn may independently represent one of a $C_1$-$C_{10}$ alkylene, a $C_3$-$C_{10}$ cycloalkylene and a $C_4$-$C_{10}$ aromatic hydrocarbon, and each of $M_1^+$ and $M_2^+$ may independently represent one of a proton, an alkali metal ion and an ammonium ion, The suppressor may include a tri-block copolymer of polyethylene oxide (PEO)-polypropylene oxide (PPO)-PEO having a weight average molecular weight of 300 to 10,000 and having an ethylene oxide content (EO %) of 1% to 99% (w/w).

In example embodiments, the dispersion plate may include a copper plate from which copper ions may be dissolved into the electroplating solution and electrons may remain therein due to a difference of electron affinity between copper of the copper plate and the positive ions in the electroplating solution. The substrate holder may include a conductive plate electrically connected to the copper plate such that the electrons of the copper plate may move to the conductive plate.

In example embodiments, an external power may be applied to an electrical circuit including the substrate holder and the dispersion plate such that a charge density on a surface of the substrate may be in a range of 0.1 $mA/cm^2$ to 300 $mA/cm^2$.

In example embodiments, the solution provider may include a mixer configured to mix additives of the accelerator, the suppressor and the leveler with the aqueous electrolyte solution to thereby produce the electroplating solution, an additive reservoir connected to the mixer, the additive reservoir containing the additives, an ejecting pump configured to eject the electroplating solution from the mixer, and a flow line connected from the mixer to the plating chamber.

According to example embodiments, a method includes forming an insulation pattern on the semiconductor chip having at least one electrode pad, the insulation pattern having a penetration hole through which the at least one electrode pad is exposed, forming a preliminary under barrier metal (UBM) layer on the insulation pattern conformal with a profile of the penetration hole, forming a mask pattern on the preliminary UBM layer and having an opening overlapping the penetration hole, the preliminary UBM layer around the penetration hole being exposed through the opening of the mask pattern, forming a preliminary copper bump on the preliminary UBM layer exposed through the opening by an electroplating process, the electroplating process using an electroplating solution including an aqueous electrolyte solution having water soluble copper salts, sulfide ions and chloride ions, an accelerator including an organic material having sulfur (S) at a concentration of 3 g/L to 100 g/L, the accelerator accelerating copper (Cu) reduction, a suppressor having a polyether compound at a concentration of 10 g/L to 500 g/L and a weight average molecular weight of 300 to 10,000, the suppressor selectively suppressing the copper reduction, and a leveler including a water soluble polymer having nitrogen that is dissolved into positive ions in the aqueous electrolyte solution at a concentration of 0.1 g/L to 10 g/L, forming a copper bump by performing a reflow process on the preliminary copper bump after removing the mask pattern, and forming an UBM layer between the copper bump and the at least one electrode pad by partially removing the preliminary UBM layer from the insulation pattern.

In example embodiments, the aqueous electrolyte solution may include copper ions at a concentration of 10 g/L to 200 g/L, the sulfide ions at a concentration of 5 g/L to 50 g/L and the chloride ions at a concentration of 10 mg/L to 100 mg/L in the electroplating solution, the leveler may include one of an N-vinyl pyrrolidone compound represented by Chemical Formula (1), a diallyldimethyl ammonium chloride (DADMAC) represented by Chemical Formula (2) and a copolymer of DADMAC and N-vinyl pyrrolidone represented by Chemical Formula (3) at a concentration of 0.1 g/L to 10 g/L in the electroplating solution, (1)

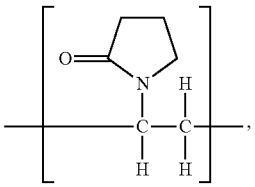

-continued (2)

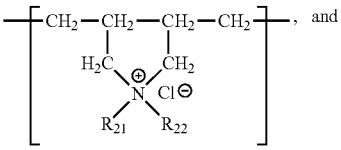

(3)

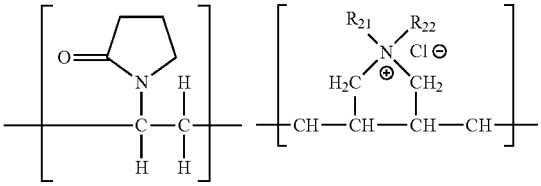

wherein each of $R_{21}$ and $R_{22}$ denote a $C_1$-$C_4$ unsubstituted alkyl group, the accelerator may include a disulfide compound represented by Chemical Formula (4), (4)

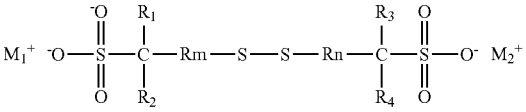

wherein each of $R_1$ and $R_3$ independently represent one of a methyl group, an ethyl group, a propyl group, an isopropyl group, an n-butyl group, a sec-butyl group, a tert-butyl group and a trimethylsilyl group, each of $R_2$ and $R_4$ independently represent one of hydrogen (H), a methyl group, an ethyl group, a propyl group, an n-butyl group, a sec-butyl group, a tert-butyl group and a trimethylsilyl group, each of Rm and Rn independently represent one of a $C_1$-$C_{10}$ alkylene, a $C_3$-$C_{10}$ cycloalkylene and a $C_4$-$C_{10}$ aromatic hydrocarbon, and each of $M_1^+$ and $M_2^+$ independently represent one of a proton, an alkali metal ion and an ammonium ion, and the suppressor includes a tri-block copolymer of polyethylene oxide (PEO)-polypropylene oxide (PPO)-PEO having a weight average molecular weight of 300 to 10,000 and having an ethylene oxide content (EO %) of 1% to 99% (w/w).

In example embodiments, the preliminary copper bump may be formed by forming the electroplating solution by mixing the accelerator, the suppressor and the leveler with the aqueous electrolyte solution, loading the semiconductor chip in the plating chamber and securing the semiconductor chip to the substrate holder, providing the electroplating solution into the plating chamber including dipping the semiconductor chip into the electroplating solution, and electroplating copper on the preliminary UBM layer exposed through the penetration hole and the opening by applying an external current to an electrical circuit including a dispersion plate having copper and the substrate holder.

In example embodiments, the electroplating solution is provided into the plating chamber at a speed of 0.1 rpm to 300 rpm under a temperature of 20° C. to 50° C.

In example embodiments, the copper is electroplated on the preliminary UBM layer at a plating speed of 4.5 μm/min to about 5.0 μm/min.

According to example embodiments, an electroplating solution includes an aqueous electrolyte solution including water soluble copper salts, sulfide ions and chloride ions, and a leveler including one of an N-vinyl pyrrolidone compound represented by Chemical Formula (1), a diallyldimethyl ammonium chloride (DADMAC) represented by Chemical Formula (2) and a copolymer of DADMAC and N-vinyl pyrrolidone represented by Chemical Formula (3), (1)

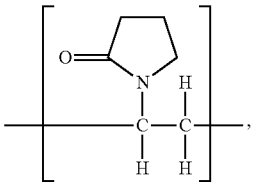

(2)

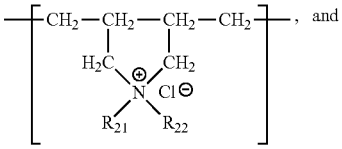

(3)

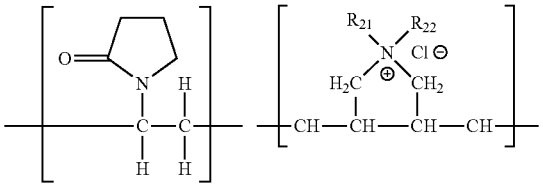

wherein each of $R_{21}$ and $R_{22}$ denote a $C_1$-$C_4$ unsubstituted alkyl group.

In example embodiments, the aqueous electrolyte solution may include copper ions at a concentration of 10 g/L to 200 g/L, the sulfide ions at a concentration of 5 g/L to 50 g/L and the chloride ions at a concentration of 10 mg/L to 100 mg/L in the electroplating solution.

In example embodiments, the leveler may include a copolymer of the N-vinyl pyrrolidone compound represented by Chemical Formula (1), the diallyldimethyl ammonium chloride (DADMAC) represented by Chemical Formula (2) and the copolymer of DADMAC and N-vinyl pyrrolidone represented by Chemical Formula (3).

In example embodiments, the electroplating solution may further include an accelerator including a disulfide compound represented by Chemical Formula (4), (4)

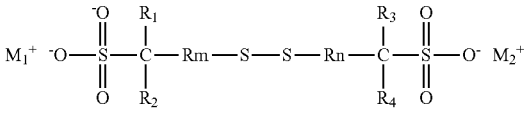

wherein each of $R_1$ and $R_3$ independently represent one of a methyl group, an ethyl group, a propyl group, an isopropyl group, an n-butyl group, a sec-butyl group, a tert-butyl group and a trimethylsilyl group, each of $R_2$ and $R_4$ independently represent one of hydrogen (H), a methyl group, an ethyl group, a propyl group, an n-butyl group, a sec-butyl group, a tert-butyl group and a trimethylsilyl group, each of Rm and Rn independently represent one of a $C_1$-$C_{10}$ alkylene, a $C_3$-$C_{10}$ cycloalkylene and a $C_4$-$C_{10}$ aromatic hydrocarbon, and each of $M_1^+$ and $M_2^+$ independently represent one of a proton, an alkali metal ion and an ammonium ion, and a suppressor including a tri-block copolymer of polyethylene oxide (PEO)-polypropylene oxide (PPO)-PEO having a weight average molecular weight of 300 to 10,000 and having an ethylene oxide content (EO %) of 1% to 99% (w/w).

In example embodiments, the leveler may be at a concentration of 0.1 g/L to 10 g/L in the electroplating solution, the accelerator may be at a concentration of about 3 g/L to about 100 g/L in the electroplating solution, and the suppressor may be at a concentration of about 10 g/L to about 500 g/L in the electroplating solution.

According to example embodiments of the present inventive concepts, a copolymer from which nitrogen positive ions may be dissolved may be mixed with the aqueous electrolyte solution as the leveler of the electroplating solution. Thus, abnormal precipitation of copper may be sufficiently prevented or inhibited at a relatively high current area at which the charge density may be locally higher over an average charge density. Accordingly, the process efficiency of the electroplating process for forming the copper bump may be sufficiently increased without deterioration of the surface flatness of the copper bump, thereby increasing an overall electroplating process of the copper.

BRIEF DESCRIPTION OF THE DRAWINGS

Example embodiments will be more clearly understood from the following detailed description taken in conjunction with the accompanying drawings.

DETAILED DESCRIPTION

Figure 1:
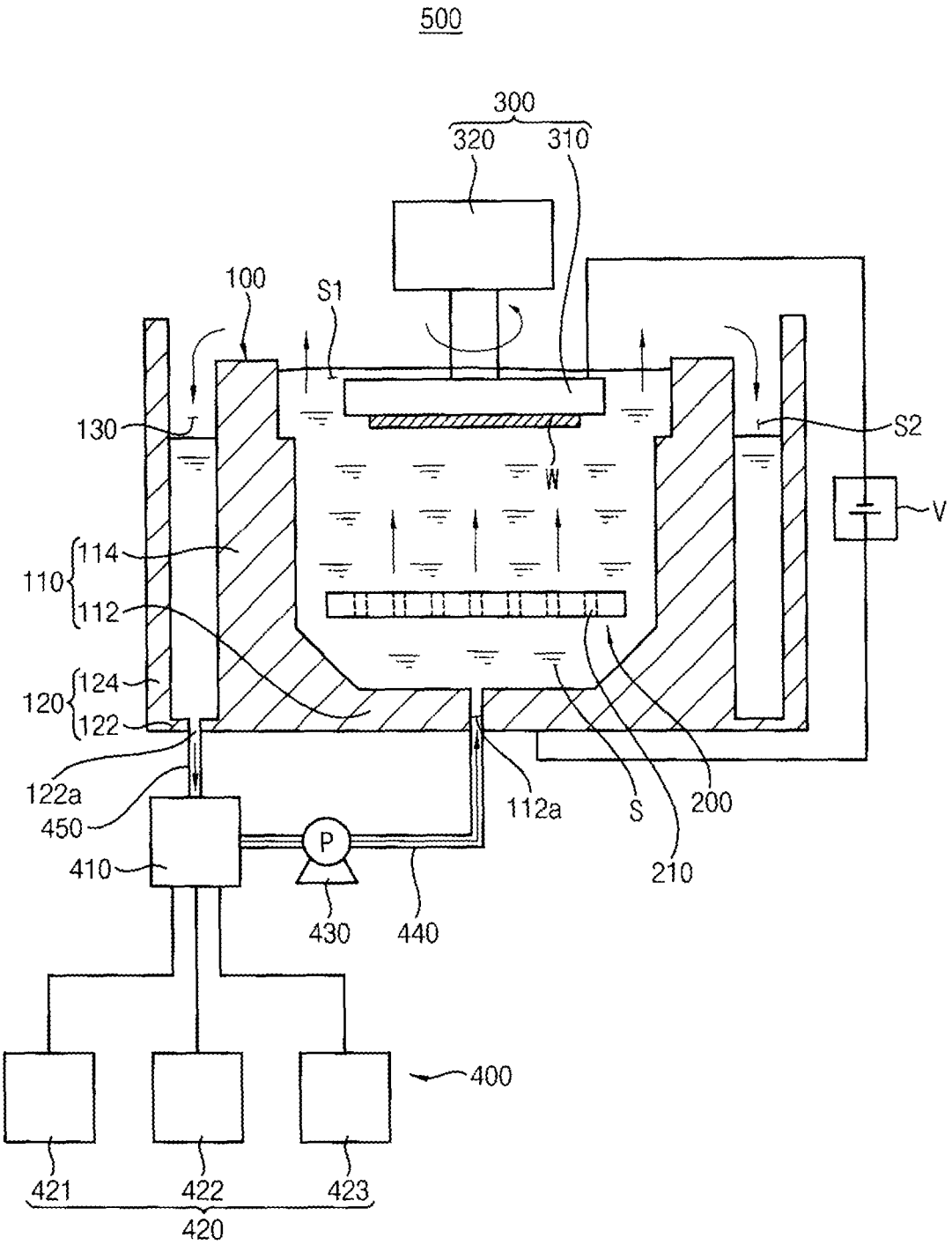
FIG. 1 is a structural view illustrating an apparatus for electroplating a copper layer in accordance with example embodiments of the present inventive concepts.

Various example embodiments will be described more fully hereinafter with reference to the accompanying drawings, in which some example embodiments are shown. The present inventive concepts may, however, be embodied in many different forms and should not be construed as limited to the example embodiments set forth herein. Rather, these example embodiments are provided so that this disclosure will be thorough and complete, and will fully convey the scope of the present inventive concepts to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concepts.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present inventive concepts.

Unless otherwise defined, all terms (including technical and scientific terms) used herein have the same meaning as commonly understood by one of ordinary skill in the art to which the inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

A copper electroplating solution for electroplating copper (Cu) in accordance with example embodiments of the present inventive concepts may include an aqueous electrolyte solution of copper salts, an accelerator having an organic material of sulfur (S) that accelerates a copper reduction reaction, a suppressor having a polyether compound that selectively suppresses the copper reduction reaction and a leveler including a water soluble polymer in which nitrogen (N) may be held that suppresses the copper reduction reaction at a local point of relatively high charge density.

For example, the aqueous electrolyte solution may include sulfide ions, chloride ions and copper slats that may be dissolved in de-ionized (DI) water. The copper salts may include copper (Cu) alkyl sulfonate and copper (II) sulfate pentahydrate ($CuSO_4.5H_2O$) dissolved in the DI water. The sulfide ions may include sulfuric acids ($H_2SO_4$) and alkyl sulfonic acids dissolved in the DI water and the chloride ions may include hydrochloric acids (HCl) dissolved in the DI water. In example embodiments, the copper salts may have a concentration of about 10 g/L to about 200 g/L and the sulfide ions may have a concentration of about 5 g/L to about 50 g/L. The chloride ions may have a concentration of about 10 mg/L to about 100 mg/L.

The accelerator may include a disulfide compound represented by the following Chemical Formula (1).

(1)

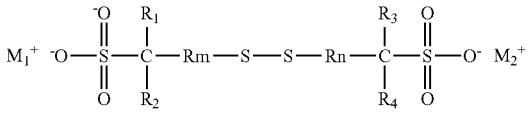

In Chemical Formula (1), each of $R_1$ and $R_3$ may independently represent one of a methyl group, an ethyl group, a propyl group, an isopropyl group, an n-butyl group, a sec-butyl group, a tert-butyl group and a trimethylsilyl group. Each of $R_2$ and $R_4$ may independently represent one of hydrogen (H), a methyl group, an ethyl group, a propyl group, an n-butyl group, a sec-butyl group, a tert-butyl group and a trimethylsilyl group. Each of Rm and Rn may independently represent one of a $C_1$-$C_{10}$ alkylene, a $C_3$-$C_{10}$ cycloalkylene and a $C_4$-$C_{10}$ aromatic hydrocarbon. Each of $M_1^+$ and $M_2^+$ may independently represent one of a proton, an alkali metal ion and an ammonium ion.

Examples of the disulfide compound may include bis-(3-sulfo-3-methylpropyl) disulfide salts, bis-(3-sulfo-3-ethylpropyl) disulfide salts, bis-(3-sulfo-3-isopropyl) disulfide salts, bis-(3-sulfo-3-t-butylpropyl) disulfide salts, bis-(3-sulfo-3-trimethylsilylpropyl) disulfide salts, bis-(3-sulfo-3,3-dimethylpropyl) disulfide salts, bis-(3-sulfo-3,3-diethylpropyl) disulfide salts, bis-(2-sulfo-2-methylethyl) disulfide salts, bis-(2-sulfo-2-ethylmethyl) disulfide salts, bis-(4-sulfo-4-methylbutyl) disulfide salts, bis-(4-sulfo-4-ethylbutyl) disulfide salts, bis-(5-sulfo-5-methylpentyl) disulfide salts, bis-(6-sulfo-6-methylhexyl) disulfide salts, 3-sulfo-3-methylpropyl 4-sulfo-4-methylbutyl disulfide salts, and 2-sulfo-2-methylpropyl 3-sulfo-3-methylpropyl disulfide salts. These may be used alone or in combinations thereof.

In example embodiments, the disulfide compound may have a concentration of about 3 g/L to about 100 g/L. When the concentration of the disulfide compound may be less than about 3 g/L, the copper may be likely to be non-uniformly plated during the electroplating process and thus the plated copper layer may have an undesirable surface flatness. When the concentration of the disulfide compound may exceed about 100 g/L, the cost of the copper electroplating solution may be undesirably high so that the productivity of the copper bump using the electroplating solution may become undesirable.

For example, the suppressor may include a copolymer of polyethylene oxide (PEO) and polypropylene oxide (PPO). Examples of the copolymer of PEO and PPO may include a polyethylene oxide (PEO) and polypropylene oxide (PPO) include a PEO-PPO-PEO tri-block copolymer, a PPO-PEO-PPO tri-block copolymer, PEO/PPO-PPO/PEO-PEO/PPO tetra-block copolymer, and a PPO/PEO-PEO/PPO-PPO/PEO tetra-block copolymer. The suppressor may have a weight average molecular weight of about 100 to about 100,000.

In example embodiments, the PEO-PPO-PEO tri-block copolymer may have a weight average molecular weight of about 300 to about 10,000, and the ethylene oxide content in the PEO-PPO-PEO tri-block copolymer (EO %) may be in a range of about 1 to about 99% (w/w). In example embodiments, the PEO-PPO-PEO tri-block copolymer may have a weight average molecular weight of about 2,500 to about 5,000, and the ethylene oxide content in the PEO-PPO-PEO tri-block copolymer (EO %) may be in a range of about 30 to about 60% (w/w).

The PEO-PPO-PEO tri-block copolymer may have a concentration of about 10 g/L to about 500 g/L. When the concentration of the PEO-PPO-PEO tri-block copolymer may be less than about 10 g/L, the copper may be likely to be non-uniformly plated during the electroplating process and thus the plated copper layer may have an undesirable surface flatness. When the concentration of the PEO-PPO-PEO tri-block copolymer may exceed about 500 g/L, the copper reduction reaction may be undesirably suppressed and thus the plating speed of the copper (Cu) may be undesirable.

For example, the leveler may include an N-vinyl pyrrolidone compound represented by the following Chemical Formula (2), a diallyldimethyl ammonium chloride (DADMAC) represented by the following Chemical Formula (3), a copolymer of DADMAC and N-vinyl pyrrolidone represented by the following Chemical Formula (4) and combinations thereof.

(2)

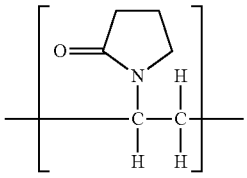

In Chemical Formula (2), the N-vinyl pyrrolidone compound may include a hydrocarbon main chain having a vinyl group ($CH_2$═CH—) and a single hetero-cyclic group substituted with nitrogen (N) in which the carbon (C) of the hydrocarbon main chain may be combined with the substituted nitrogen (N). The trivalent nitrogen (N) of the N-vinyl pyrrolidone compound may be dissolved into positive ions in the aqueous acidic electrolyte solution.

(3)

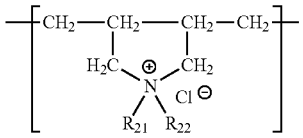

In Chemical Formula (3) of DADMAC, the terms $R_{21}$ and $R_{22}$ denote a $C_1$-$C_4$ unsubstituted alkyl group, respectively.

A pair of monomers having allyl groups ($CH_2$═CH—$CH^{2-}$) may be polymerized by a condensation of the allyl groups and thus the DADMAC may be produced in which the pair of the allyl groups may be chained by the condensation. For example, $R_{21}$ and $R_{22}$ in Chemical Formula (2) may include a methyl group and/or an ethyl group. The quad-valent nitrogen (N) of the DADMAC may be dissolved into positive ions in the aqueous acidic electrolyte solution.

(4)

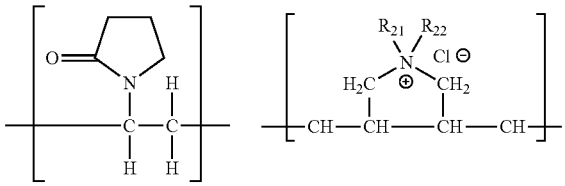

In Chemical Formula (4), the terms $R_{21}$ and $R_{22}$ denote a $C_1$-$C_4$ unsubstituted alkyl group, respectively, just like the Chemical Formula of DADMAC.

The copolymer represented in Chemical Formula (4) may be provided by a condensation reaction of the vinyl group ($CH_2$═$CH^-$) in the N-vinyl pyrrolidone compound and the allyl group ($CH_2$═CH—$CH^{2-}$) in the DADMAC. The trivalent nitrogen and quad-valent nitrogen of the copolymer in Chemical Formula (4) may be dissolved into positive ions in the aqueous acidic electrolyte solution.

Accordingly, when the above examples of the leveler may be added to the electrolyte solution, trivalent and/or quad-valent nitrogen ions may be sufficiently dissolved in the electrolyte solution and thus the concentration of the positive ions may be increased in the electrolyte solution. The positive ions may be focused to a relatively high current area of a to-be-plated object at which a larger amount of electrical currents may be applied and thus the charge density may be locally higher than surroundings, and may suppress the copper precipitation at the high current area of the to-be-plated substrate. In example embodiments, the to-be-plated substrate may include an IC chip to which copper may be coated by the electroplating process so as to form the copper bump on the IC chip.

Therefore, although a larger amount of the electrical currents may be applied for increasing the electroplating speed and thus the charge density may be increased on the to-be-plated substrate, the precipitation increase of the copper may be sufficiently prevented or inhibited due to the plentiful positive ions in the electroplating solution. The current intensity may be varied along the surface of the to-be-plated substrate when a larger amount of the current may be applied to the to-be-plated substrate. However, the nitrogen (N) positive ions in the electroplating solution may be focused to the relatively high current area, and thus the copper precipitation corresponding to the high current may be prevented or inhibited. Therefore, the copper precipitation may uniformly occur along the surface of the to-be-plated substrate in spite of the variation of the current intensity distribution. Accordingly, the copper may be uniformly plated onto the to-be-plated substrate with high current intensity and as a result with high plating speed.

The concentration of the leveler may be varied according to the amount of the positive ions that may be required for reducing the charge density of the high current area to an average charge density of the to-be-plated substrate. Because the amount of the positive ions may be varied according to the degree of ionization of the leveler in the electrolyte solution. Thus, the amount of the nitrogen positive ions may be varied in accordance with the organic materials of the leveler and the degree of dissociation of the trivalent or quad-valent nitrogen (N) ions from the organic materials. Particularly, in the case that the leveler may include the copolymers represented in Chemical Formulae (3) and (4), the amount of the nitrogen (N) ions may be varied according to the number of monomers that may be combined into the copolymer of the leveler.

When the amount of the positive ions may be undesirably large in the electrolyte solution, some of the positive ions may be included in the precipitated copper and thus the plated copper layer may have greater brittleness. In addition, the copper reduction may be suppressed on the surface of the to-be-plated substrate and the plating speed may be reduced due to the positive ions in the electrolyte solution. For those reasons, the leveler may be selected from a viewpoint that the amount of the positive ions may be proper to the charge density on the surface of the to-be-plated substrate.

In example embodiments, DADMAC may be used as the leveler and the number of the monomers for the DADMAC may be controlled in such a way that the DADMAC may have an average molecular weight of about 100 to about 500,000. In addition, the concentration of DADMAC in the electroplating solution may be controlled in a range of about 0.1 g/L to about 10 g/L. When the concentration of DADMAC may be less than about 0.1 g/L, the nitrogen positive ions may be insufficient for reducing the charge density at the relatively high current area of the to-be-plated substrate. In contrast, when the concentration of DADMAC may be over about 100 g/L, the nitrogen positive ions may be sufficiently large that the plating speed of the copper may be reduced.

In example embodiments, the N-vinyl pyrrolidone compound represented by Chemical Formula (2) may be disclosed as one of example organic materials having the trivalent nitrogen (N) and the DADMAC represented by Chemical Formula (3) may be disclosed as example organic materials having quad-violent nitrogen (N). In the same way, the copolymer represented by Chemical Formula (4) may be disclosed as one of example organic materials having both of the trivalent nitrogen (N) and the quad-violent nitrogen (N). Therefore, the foregoing materials of the N-vinyl pyrrolidone compound, the DADMAC and the copolymer of the DADMAC and the N-vinyl pyrrolidone compound is not to be construed as limiting thereof and various organic materials may be utilized as the leveler of the electroplating solution as long as the organic material may just include nitrogen (N) that may be dissolved into the electrolyte solution as the positive ions.

For example, an N-vinyl limidazole compound and/or an N-vinyl caprolactam compound may be utilized as the organic materials having the trivalent nitrogen (N) in place of the N-vinyl pyrrolidone compound. Further, various copolymers of the organic materials having the trivalent nitrogen (N) and of the organic materials having the quad-valent nitrogen (N) may also be utilized as the leveler of the electroplating solution, as would be known to one of the ordinary skill in the art.

According to example embodiments of the copper electroplating solution, when a larger amount of the currents may be applied to the to-be-plated substrate so as to increase the electroplating speed of copper and thus the charge density may be locally increased at the relatively high density area of the to-be-plated substrate, the positive nitrogen ions (III or IV) in the aqueous electrolyte solution may be focused to the relatively high density area, and thus the charge density of the relatively high density area may be reduced to the average charge density of the to-be-plated substrate. As a result, the charge density may be controlled to be uniform on a whole surface of the to-be-plated substrate and thus the copper may be uniformly precipitated along the whole surface of the to-be-plated substrate. Accordingly, the copper layer may be formed at sufficiently high speed without any deterioration of the surface flatness thereof by the electroplating process using the copper electroplating solution.

FIG. 1 is a structural view illustrating an apparatus for electroplating a copper layer in accordance with example embodiments of the present inventive concepts.

Referring to FIG. 1, an apparatus 500 for electroplating a copper layer (if necessary, referred to as copper electroplating apparatus) in accordance with example embodiments of the present inventive concepts may include a plating chamber 100 containing an electroplating solution S, a dispersion plate 200 dipped into the electroplating solution S and uniformly dispersing the electroplating solution S to a surface of a to-be-plated substrate W, a substrate holder 300 holding the to-be-plated substrate W and electrically connected to the dispersion plate 200, an external power V as an electrical circuit and a solution provider 400 providing the electroplating solution S to the plating chamber 100.

The plating chamber 100 may include an inner body 110 having a first space S1 for holding the electroplating solution S and an outer body 120 enclosing the inner body 110 in such a configuration that a retrieving path 130 for the electroplating solution S may be provided between the inner body 110 and the outer body 120. The retrieving path 130 may include a second space S2 that communicates with the first space S1 between the inner body 110 and the outer body 120. The retrieving path 130 may be connected to the solution provider 130, and thus the electroplating solution S overflowed from the first space S1 may be collected to the second space S2 and be guided into the solution provider 400. That is, when overflowing from the inner body 110, the electroplating solution S may be retrieved to the solution provider 400 through the retrieving path 130. The retrieved solution may also be provided into the first space S1, so that the retrieved solution may also be re-provided into the first space S1 of the inner body 110.

For example, the inner body 110 may include a first bottom 112 and a first sidewall 114 extending upwards from the first bottom 112 and having the first space S1 at a central portion thereof. Thus, the first space S1 may be defined by the first bottom 112 and the first sidewall 114. The first bottom 112 may include a first opening 112*a* through which the first space S1 may be communicated with a mixer 410 of the solution provider 400.

The outer body 120 may include a second bottom 122 extending horizontally from the first bottom 112 and a second sidewall 124 extending upwards from the second bottom 122 and spaced apart from the first sidewall 114. Thus, the second space S2 may be provided between the first sidewall 114 and the second sidewall 124. The second bottom 122 may include a second opening 122*a* through which the second space S2 may communicate with the mixer 410 of the solution provider 400. The electroplating solution S overflowed from the first space S1 of the inner body 110 may be collected into the second space S2 and may be retrieved again into the mixer 410 through the second opening 122*a*. That is, the electroplating solution S overflowed from the first space S1 may be retrieved into the solution provider 400 through the second space S2, and thus the second space S2 may function as the retrieving path of the electroplating solution S.

The electroplating solution may include an aqueous electrolyte solution of copper salts and an accelerator, a suppressor and a leveler that may be dissolved into the electrolyte solution, as described in the above copper electroplating solution. The accelerator may have an organic material of sulfur (S) and accelerate a copper reduction reaction. The suppressor may have a polyether compound and selectively suppress the copper reduction reaction. The leveler may include a water soluble polymer having nitrogen (N) and suppress the copper reduction reaction at a local point of relatively high charge density.

Particularly, the leveler may include an N-vinyl pyrrolidone compound represented by Chemical Formula (2), a diallyldimethyl ammonium chloride (DADMAC) represented by Chemical Formula (3), a copolymer of DADMAC and N-vinyl pyrrolidone represented by Chemical Formula (4) and combinations thereof. The electroplating solution S may be contained in a reservoir at a temperature of about 20° C. to about 50° C.

For the above compositions of the electroplating solution S, although a larger amount of the current may be applied to the to-be-plated substrate W, the surface flatness of the copper layer electroplated on the substrate W may not be deteriorated. Thus, the plating speed may be sufficiently increased without deterioration of the surface flatness of the copper layer when using the electroplating solution S. The electroplating solution S may have substantially the same compositions of the copper above-described electroplating solution, and thus any further detailed descriptions on the electroplating solution S may be omitted.

The dispersion plate 200 may be shaped into a plate and be positioned close to the first opening 112*a* of the inner body 110. A plurality of dispersion holes 210 may be provided with the dispersion plate 200.

The electroplating solution S may be provided into the first space S1 through the first opening 112*a* and may be uniformly dispersed in the first space S1 through the dispersion holes 210. Thus, when the substrate W may be dipped into the electroplating solution S, the electroplating solution S may flow on the surface of the substrate W uniformly.

Particularly, the dispersion plate 200 may include copper and thus copper oxidation reaction may occur on the dispersion plate 200 in the electroplating solution S. Copper ions may be dissolved into the electroplating solution S due to the difference of the electron affinity between the copper and the positive ions in the electroplating solution. For example, the dispersion plate 200 may include a copper plate. However, any other plates may also be utilized as the dispersion plate 200 as long as copper ions may be dissolved out from the dispersion plate due to the difference of the electron affinity.

The to-be-plated substrate W may be secured to a lower surface of the substrate holder 300 and may be electrically connected to the dispersion plate 200. Electrical power source V may be connected to both the substrate holder 300 and the dispersion plate 200, and thus the substrate holder 300, the dispersion plate 200 and the electrical power V may constitute an electrical circuit. An external current may be applied to the to-be-plating substrate W by the electrical power V, and thus the electrical circuit including the substrate W and the dispersion plate 200 may be completed.

For example, the substrate holder 300 may include a conductive plate 310 electrically connected to the dispersion plate 200 and to which the to-be-plated substrate W may be secured and a driver 320 for driving the conductive plate 310.

When copper ions may be dissolved into the aqueous electrolyte solution from the dispersion plate 200 due to the difference of the electron affinity, electrons may increase inside of the dispersion plate 200. Thus, when an electrical power may be applied to a conductive line with which the dispersion plate 200 and the substrate holder 300 may be connected, the electrons in the dispersion plate 200 may flow toward the substrate holder 300 through the conductive line. Thus, the dispersion plate 200 may function as a cathode and the substrate holder 300 may function as an anode in the electrical circuit and the electrical current may flow to the dispersion plate from the substrate holder 300. The electrons moved to the substrate holder 300 may be finally transferred to the to-be-plated substrate W.

The copper ions in the aqueous electrolyte solution may be combined with the electrons on a surface of the to-be-plated W and copper atoms may be precipitated on the substrate W. As a result, a copper layer may be formed on the substrate W by the electroplating process.

Particularly, the substrate W may be rotated by the driver 320, and thus the copper layer may be uniformly coated on a whole surface of the substrate W. For example, the substrate W may be rotated at an angular speed of about 0.1 rpm to about 3000 rpm according to a surface profile of the to-be-plated substrate W.

The amount of the precipitated copper may be proportional to the intensity of the electrical current that may be applied to the substrate W. The more the intensity of the applied current, the greater the number of the electrons that may be moved to the conductive plate 310, and the greater the number of the electrons in the conductive plate 310, the more the intensity of the reduction reaction of copper. Therefore, the more the intensity of the applied current, the more the copper may be precipitated on the substrate W, which may increase the plating speed of the copper.

Because various structures may be formed on the to-be-plated substrate W by various processes for manufacturing semiconductor devices, the external current applied to the to-be-plated substrate W may not cause a uniform distribution of the charge density on a whole surface of the to-be-plated substrate W. That is, the charge density may be relatively higher at some points and be relatively lower at other points according to the surface profile of the substrate W. The non-uniformity of the charge density on the surface of the substrate W may be intensified in proportion to the intensity of the applied current. The copper reduction reaction may be conducted more vehemently at a relatively high current area at which the charge density may be higher than others, and thus the copper layer may be formed to a greater thickness at the relatively high current area. As a result, the copper layer may be formed to a non-uniform thickness on the substrate W and the surface flatness of the copper layer may be deteriorated.

However, the leveler of the electroplating solution S may include a sufficient amount of nitrogen positive ions in the aqueous electrolyte solution. The positive ions may be focused onto the relatively high current area of the substrate W and may be combined with the electrons that may be combined with the copper ions to precipitate copper atoms. Thus, the number of the electrons combining with the copper ions may be sufficiently reduced by the positive ions of the leveler. Particularly, the number of the electrons at the relatively high current area may be reduced to an average number of the electrons of the substrate W. Therefore, the copper reduction reaction may be uniformly conducted on the surface of the substrate W and the copper layer may be plated to a uniform thickness on the substrate W although a larger amount of the current may be applied to the to-be-plated substrate W. However, because the intensity of the applied current may be increased, the plating speed of the copper may be increased. Accordingly, when the copper layer may be electroplated by using the electroplating solution, the plating speed of the copper may be sufficiently increased by increasing the intensity of the applied current without deterioration of the surface flatness of the copper layer.

In example embodiments, the surface flatness of the copper layer may be controlled to be below about 10% and the plating speed of the copper may be controlled in a range of about 4.5 μm/min to about 5.0 μm/min.

The intensity of the applied current may be varied according to a surface profile of a location at which the copper may be plated. When a copper bump may be formed on a contact pad of an integrated circuit (IC) chip by an electroplating process, the electrical current may be applied to the substrate W in such a way that the average charge density of the to-be-plated substrate W may be in a range of about 0.1 $mA/cm^2$ to about 300 $mA/cm^2$.

When an interconnector (e.g., a plug, a via and a contact) for a wiring structure of the IC chip may be formed in a contact hole by an electroplating process, the variation of the charge density along a whole surface of the to-be-plated substrate W may be relatively greater than the variation of the charge density when forming the copper bump.

In contrast, when a copper layer may be formed on a flat surface having no recesses and protrusions by an electroplating process, the variation of the charge density along a whole surface of the to-be-plated substrate W may be relatively smaller than the variation of the charge density when forming the copper bump.

Thus, when filling the contact hole by the electroplating process, the increase of the applied current may be limited so as to minimize or reduce the variation of the charge density. However, when depositing a copper layer on a flat surface of the to-be-plated substrate, a greater increase of the applied current may be allowable because the variation of the charge density may be limited for the surface profile of the to-be-plated substrate.

Thus, when a copper interconnector may be formed in the contact hole by an electroplating process using the electroplating solution, the electrical current may be applied to the substrate W in such a way that the average charge density of the to-be-plated substrate W may be in a range of about 0.1 $mA/cm^2$ to about 100 $mA/cm^2$. In contrast, when a copper layer may be formed on a flat surface by an electroplating process using the above electroplating solution, the electrical current may be applied to the substrate W in such a way that the average charge density of the to-be-plated substrate W may be in a range of about 1 $mA/cm^2$ to about 300 $mA/cm^2$. Accordingly, the electroplating process using the above copper electroplating solution may also increase the plating speed of copper in the deposition process for forming the copper layer and the filling process for forming the interconnector without deterioration of surface flatness of the layer as well as in the process for forming the copper bump.

The solution provider 400 may include a mixer 410 in which various additives, for example, the accelerator, the suppressor and the leveler, may be mixed with the aqueous electrolyte solution to thereby produce the electroplating solution S, an additive reservoir 420 connected to the mixer 410 and containing the additives required for the electroplating solution S individually, an ejecting pump 430 for ejecting the electroplating solution S from the mixer 410 and a flow line 440 connected from the mixer 410 to the first space S1 of the plating chamber 100.

The mixer 410 may contain the aqueous electrolyte solution having copper salts and the additive reservoir 420 may include a first reservoir 421 containing the accelerator, a second reservoir 422 containing the suppressor and a third reservoir 423 containing the leveler. The accelerator, the suppressor and the leveler may be individually supplied to the mixer 410 and may be mixed with the aqueous electrolyte solution in the mixer 410. In example embodiments, first to third valves (not illustrated) may be installed between the mixer 410 and each of the first to third reservoirs 421 to 423, respectively, so that the flux of the accelerator, the suppressor and the leveler may be individually controlled when producing the electroplating solution S in the mixer 410.

For example, the aqueous electrolyte solution in the mixer 410 may include sulfide ions, chloride ions and copper slats that may be dissolved in de-ionized (DI) water. The copper salts and the sulfide ions may have a concentration of about 0.1 g/L to about 1,000 g/L and the chloride ions may have a concentration less than about 1,000 mg/L. The accelerator in the first reservoir 421 may include a disulfide compound at a concentration of about 0.1 mg/L to about 10 g/L and the suppressor in the second reservoir 422 may include a PEO-PPO-PEO tri-block copolymer at a concentration of about 1 mg/L to about 500 g/L. The leveler in the third reservoir 423 may include DADMAC at a concentration of about 0.1 mg/L to about 10 g/L. Particularly, the number of the monomers for the DADMAC may be controlled in such a way that DADMAC may have an average molecular weight of about 100 to about 500,000.

Each of the additives may be supplied to the mixer 410 from each of the first to third reservoirs and may be mixed with the aqueous electrolyte solution having the copper salts, so that the copper electroplating solution S may be produced in the mixer 410. The electroplating solution S may be provided into the first space S1 of the inner body 110 by the ejecting pump 430.

A flux controller (not illustrated) may be further installed in the ejecting pump 430 or on the flow line 440, and thus the flux of the electroplating solution S provided to the plating chamber 100 may be controlled by the flux controller. For example, the electroplating solution S may be provided into the plating chamber 100 at a volume rate of 0.1 liter per minute (LPM) to about 300 LPM.

The electroplating solution S may be provided to such a degree that the substrate holder 300 may be sufficiently dipped into the electroplating solution S in the first space of the plating chamber 100. That is, the to-be-plated substrate W may be sufficiently dipped into the electroplating solution S in the plating chamber 100.

When the electroplating solution S may be undesirably provided to the plating chamber 100 over the volume of the first space S1, the electroplating solution S may be overflowed from the inner body 110 to the retrieving path 130, a second space S2 between the inner body 110 and the outer body 120, and thus the overflowed electroplating solution S may be retrieved to the mixer 410 again. A retrieve line 450 may be further installed between the mixer 410 and the retrieving path 130.

According to the above example embodiments of the electroplating apparatus, when a larger amount of the current may be applied to the to-be-plated substrate as to increase the electroplating speed of copper and thus the charge density may be locally increased at the relatively high density area of the to-be-plated substrate, the positive nitrogen ions (III or IV) in the aqueous electrolyte solution may be focused to the relatively high density area, and thus the charge density of the relatively high density area may be reduced to the average charge density of the to-be-plated substrate. As a result, the charge density may be controlled to be uniform on a whole surface of the to-be-plated substrate and thus the copper may be uniformly precipitated along the whole surface of the to-be-plated substrate. Accordingly, the copper layer may be formed at sufficiently high speed without any deterioration of the surface flatness thereof by the electroplating process using the copper electroplating solution.

FIGS. 2 to 7 are cross-sectional views illustrating processing steps for a method of forming a copper bump on an IC chip using the electroplating apparatus shown in FIG. 1.

Figure 2:
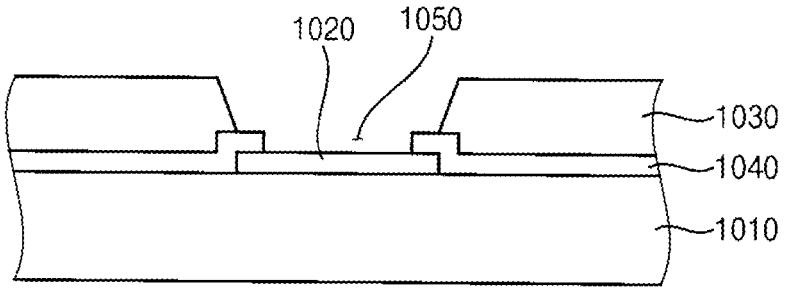
FIGS. 2 to 7 are cross-sectional views illustrating processing steps for a method of forming a copper bump on an IC chip using the electroplating apparatus shown in FIG. 1.

Referring to FIG. 2, an integrated circuit (IC) chip may be provided and a contact pad 1020 may be exposed to surroundings.

For example, the IC chip may include a plurality of transistor structures (not illustrated) and a plurality of wiring structures (not illustrated) on a semiconductor substrate 1010, for example, a wafer. The transistor structure may be formed on the wafer and first insulation interlayers (not illustrated) may cover the transistor structures, and thus the transistor structure may be electrically separated from one another by the first insulation interlayer. The wiring structures may be arranged on the first insulation interlayer and may make contact with the transistor structure penetrating through the first insulation interlayer. The wiring structures may also be covered with second insulation interlayers (not illustrated) and the contact pad 1020 may be arranged on the second insulation interlayers. The contact pad 1020 may also make contact with the wiring structure penetrating though the second insulation interlayers.

A passivation layer (not illustrated) may be arranged on the second insulation layers and thus the contact pad 1020 may be covered with the passivation layer. The passivation layer may be patterned into a passivation pattern 1040 through which the contact pad may be partially exposed. An insulation pattern 1030 may be arranged on the passivation pattern 1040, so that the contact pad 1020 may be exposed through a penetration hole 1050 that may be defined by the passivation pattern 1040 and the insulation pattern 1030. In subsequent processes, a copper bump may be arranged on the contact pad 1020 through the penetration hole 1050.

The passivation pattern 1040 may include a buffer pattern for bearing a weight of the copper bump and for absorbing mechanical stresses during a subsequent reflow process. For example, the buffer pattern may comprise organic materials, for example, polymers.

Figure 3:
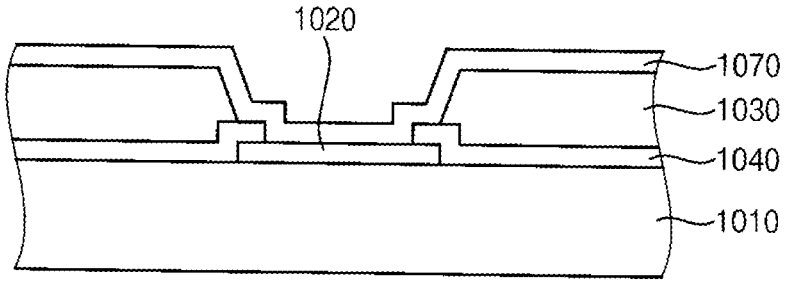

Referring to FIG. 3, a preliminary under-barrier metal (UBM) layer 1070 may be formed on the insulation pattern 1030 and on the contact pad 1020 conformal with a surface profile of the penetration hole 1050 by a sputtering process.

Figure 6:
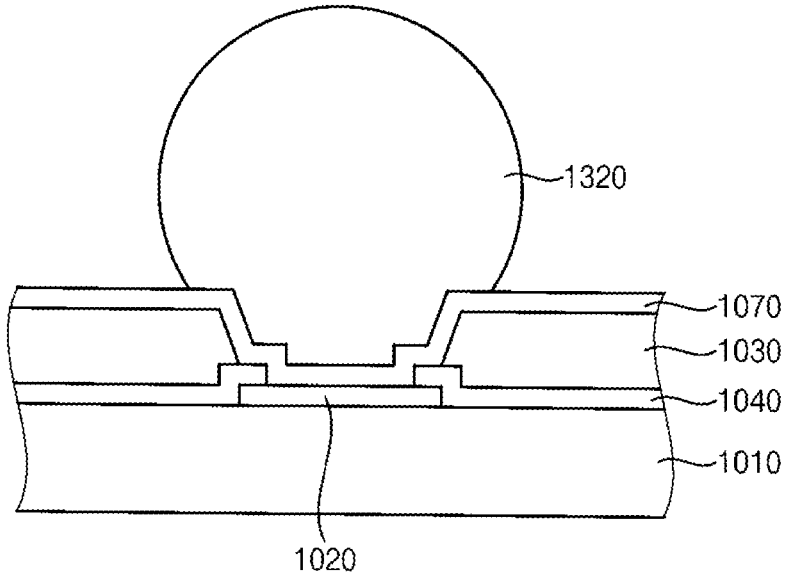

The preliminary UBM layer 1070 may include a glue layer for reinforcing adhesion between the contact pad 1020 and the copper bump 1320 in FIG. 6 and a barrier layer for preventing or inhibiting copper diffusion into the insulation pattern and the contact pad 1020 during the reflow process. Particularly, when performing a copper electroplating process, the preliminary UBM layer 1070 may function as a seed layer. In example embodiments, the preliminary UBM layer 1070 may include the barrier layer comprising chrome (Cr) or titanium (Ti) and the glue layer comprising copper (Cu) or tungsten (W).

Figure 4:
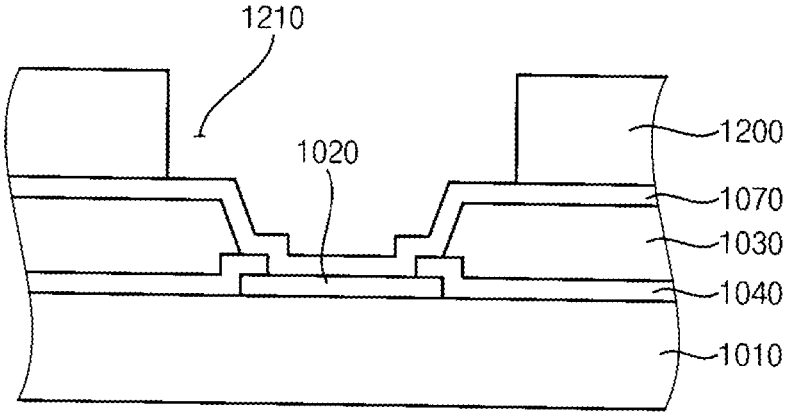

Referring to FIG. 4, a mask pattern 1200 may be formed on the preliminary UBM layer 1070 in such a way that an opening 1210 overlapping the penetration hole 1050 may be provided through the mask pattern 1200.

For example, a photoresist layer (not illustrated) may be formed on the preliminary UBM layer 1070 and partially removed from the preliminary UBM layer 1070 by a photolithography process correspondently to the contact pad 1020, and thus the photoresist layer over the contact pad 1020 may be removed from the preliminary UBM layer 1070, thereby forming the mask pattern 1200. In the present example, the opening 1210 of the mask pattern 1200 may be communicated with the penetration hole 1050 and may have a size larger than the penetration hole 1050, so that the preliminary UBM layer 1070 around the penetration hole 1050 may also be exposed through the opening 1210. Therefore, the penetration hole 1050 may be sufficiently aligned with the opening 1210 of the mask pattern 1200, and thus the alignment margin between the penetration hole 1050 and the opening 1210 may be sufficiently increased.

Figure 5:
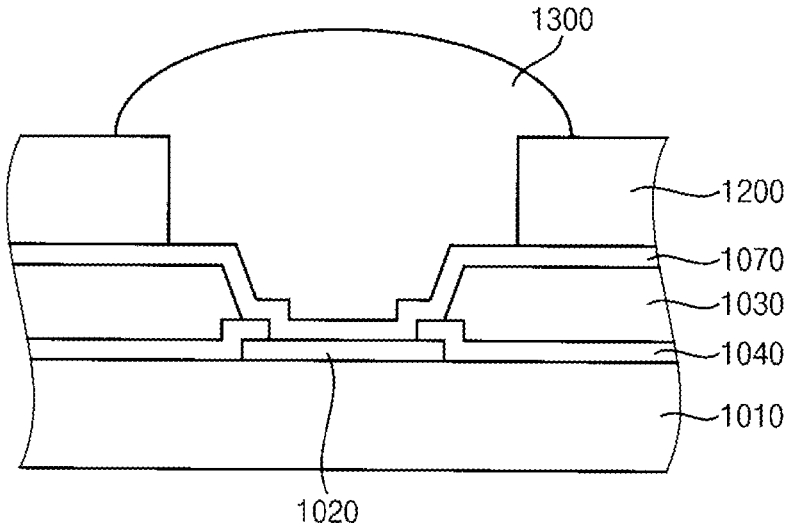

Referring to FIG. 5, a preliminary copper bump 1300 may be formed on the mask pattern 1200 to fill the opening 1210 and the penetration hole 1050 by an electroplating process.

For example, the IC chip having the mask pattern 1200 may be loaded into the electroplating apparatus 500 shown in FIG. 1. The IC chip having the mask pattern 1200 may be dipped into the copper electroplating solution S and an electrical current may be applied to the IC chip by the electrical power V.

Figure 8:
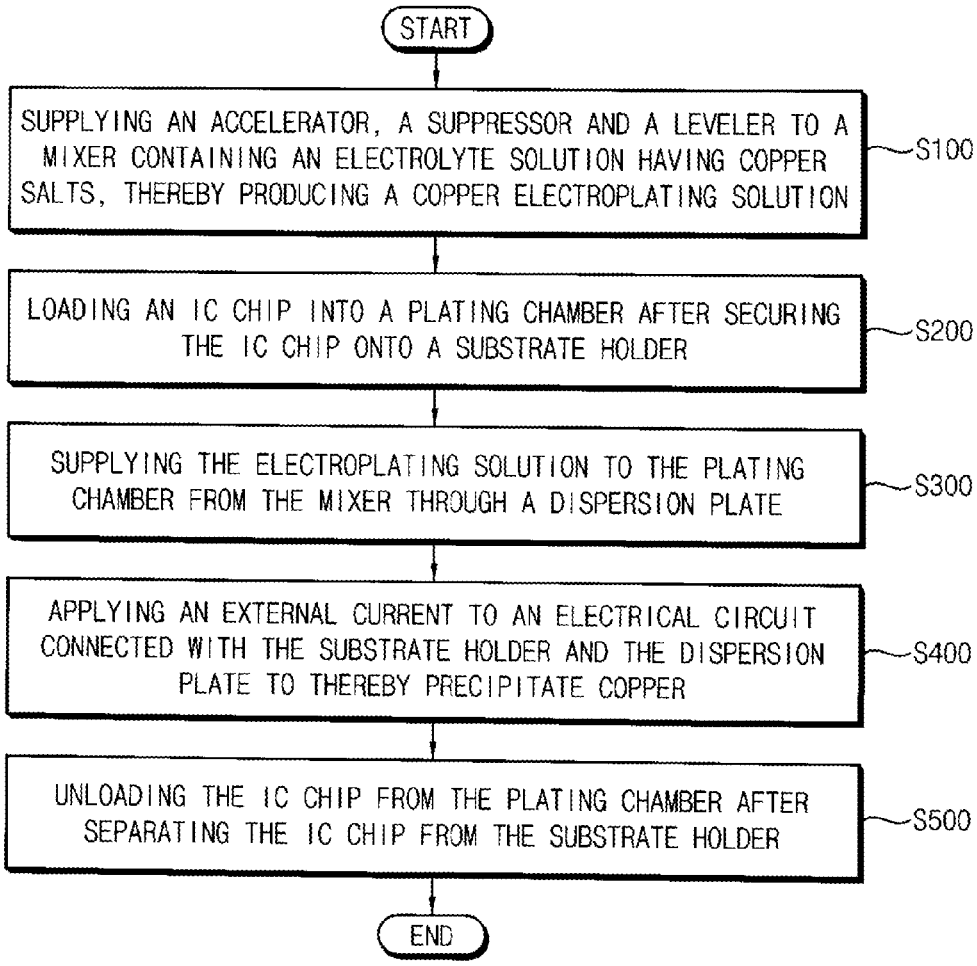
FIG. 8 is a flow chart showing the processing steps for a method of forming the preliminary copper bump shown in FIG. 6 in the electroplating apparatus shown in FIG. 1.

FIG. 8 is a flow chart showing the processing steps for a method of forming the preliminary copper bump shown in FIG. 6 in the electroplating apparatus shown in FIG. 1.

Referring to FIG. 8, the accelerator, the suppressor and the leveler may be supplied to the mixer 410 containing the aqueous electrolyte solution having copper salts, thereby producing the copper electroplating solution S in the mixer 410 (S100).

For example, the aqueous electrolyte solution in the mixer 410 may include sulfide ions, chloride ions and copper slats that may be dissolved in de-ionized (DI) water. The copper salts may have a concentration of about 10 g/L to about 200 g/L and the sulfide ions may have a concentration of about 5 g/L to about 50 g/L. The chloride ions may have a concentration of about 10 mg/L to about 100 mg/L. The aqueous electrolyte solution may be contained in the mixer 410. Otherwise, the aqueous electrolyte solution may be supplied to the mixer 410 from an additional chamber (not illustrated) in which the DI, sulfide ions, chloride ions and copper slats may be mixed with one another.

Then, the accelerator, the suppressor and the leveler may be supplied to the mixer 410 from the additive reservoir 420 and may be mixed with the aqueous electrolyte solution in the mixer 410. The accelerator may have an organic material of sulfur (S) and accelerate a copper reduction reaction. The suppressor may have a polyether compound and selectively suppress the copper reduction reaction. The leveler may include a water soluble polymer in which nitrogen (N) may be hold and may suppress the copper reduction reaction at a local point of high charge density.

The concentration of the accelerator, the suppressor and the leveler may be the same as those of the copper electroplating solution S that may be described in the above, and thus the accelerator, the suppressor and the leveler may be supplied to the mixer 410 from the first to third reservoirs 421 to 423, respectively, to such an amount that the concentration of the accelerator, the suppressor and the leveler may be maintained in the mixer 410.

Particularly, the leveler may include an N-vinyl pyrrolidone compound represented by Chemical Formula (2), a diallyldimethyl ammonium chloride (DADMAC) represented by Chemical Formula (3), a copolymer of DADMAC and N-vinyl pyrrolidone represented by Chemical Formula (4) and combinations thereof in such compositions that trivalent and/or quad-valent nitrogen (N) ions may be included in the leveler. Accordingly, when a larger amount of the currents may be applied to the IC chip so as to increase the electroplating speed of copper and thus the charge density may be locally increased at the relatively high density area of the to-be-plated substrate, the positive nitrogen ions (III or IV) in the aqueous electrolyte solution may be focused to the relatively high density area, and thus the charge density of the relatively high density area may be reduced to the average charge density of the IC chip.

As a result, the charge density may be controlled to be uniform on a whole surface of the IC chip, and thus the copper may be uniformly precipitated along the whole surface of the IC chip. Accordingly, the copper layer may be formed at sufficiently high speed without any deterioration of the surface flatness thereof by the electroplating process using the copper electroplating solution.

The IC chip including the mask pattern 1200 may be secured to the substrate holder 300 and may be loaded into the plating chamber 100 (S200). The IC chip including the mask pattern 1200 may be secured to the conductive plate 310 of the substrate holder 300 and the conductive plate 310 may be moved in the first space S1 of the inner body 110 by the driver 320. Once the conductive plate 310 may be located at a proper positioned in the first space S1, the driver 320 may rotate the conductive plate 310 at a rotating speed. In addition, the driver may also control the IC chip to have a plating temperature at a surface thereof for a preparation of the electroplating process. For example, the conductive plate 310 may be rotated at an angular speed of 2 rpm to about 10 rpm and the temperature of the IC chip may be controlled in a range of about 20° C. to about 50 C. The electroplating solution S may be uniformly provided on a whole surface of the IC chip due to the rotation of the conductive plate 310.

The electroplating solution S may be supplied to the first space S1 of the plating chamber 100 from the mixer 410 (S300).

For example, the electroplating solution S may be discharged from the mixer by the ejecting pump 430 at a flux of about 0.1 LPM to about 300 LPM and supplied to the plating chamber 100 via the flow lines 440. The temperature of the flow line 440 may be maintained in a range of about 20° C. to about 50° C. during the electroplating solution supply. Because the surface temperature of the IC chip may be maintained at a temperature of about 20° C. to about 50° C. and the IC chip may be rotated at the speed of about 2 rpm to about 100 rpm, the electroplating solution S may uniformly flow around the IC chip.

Particularly, the electroplating solution S may be provided into the first space S1 through the first opening 112*a* and may be uniformly dispersed in the whole area of the first space S1 through a plurality of the dispersion holes 210 of the dispersion plate 200.

When the IC chip may be sufficiently dipped in the electroplating solution S in the first space S1 of the plating chamber 100, an external current may be applied to the electrical circuit with which the conductive plate 310 and the dispersion plate 200 may be connected by the electrical power V and copper (Cu) may be precipitated on the preliminary UBM layer 1070 from the electroplating solution S (S400). Particularly, the preliminary UBM layer 1070 may function as a seed layer for the electroplating process. Therefore, the copper layer may be grown from a surface of the preliminary UBM layer 1070 until the opening 1210 and the penetration hole 1050 may be filled with the copper layer.

For example, the dispersion plate 200 may include a copper plate. Copper ions may be dissolved into the aqueous electrolyte solution from the dispersion plate 200 and electrons may be accumulated in the dispersion plate 200. Then, when external currents may be applied to the circuit of the dispersion plate 200 and the conductive plate 310, the electrons may move to the conductive plate 310 from the dispersion plate 200. Therefore, the copper ions in the aqueous electrolyte solution may be combined with the electrons on the preliminary UBM layer 1070 of the IC chip secured to the conductive plate 310, so that copper atoms may be precipitated on the preliminary UBM layer 1070.

The electrical current may be applied to the circuit by the external power V in such a degree that the charge density on the preliminary UBM layer 1070 may be in a range of about 0.1 $mA/cm^2$ to about 300 $mA/cm^2$. In such conditions, the plating speed of the copper may be increased in a range of about 4.5 μm/min to about 5.0 μm/min. The charge density may be varied according to the amount of the precipitating rate of the copper on the preliminary UBM layer 1070.

In case that the charge density may be abnormally increased due to the relatively high density of the applied current, the positive ions of nitrogen (III or IV) dissolved from the leveler into the electroplating solution S may prevent or inhibit the abnormal growth of the copper layer on the preliminary UBM layer 1070. Thus, although the intensity of the applied current may be high, the copper layer may be uniformly formed on the preliminary UBM layer 1070 without deterioration of the surface flatness. In example embodiments, the surface flatness of the copper layer on the preliminary UBM layer 1070 may be less than about 10%.

Accordingly, the penetration hole 1050 and the opening 120 may be sufficiently filled with copper by the electroplating process using the copper electroplating solution S, thereby forming a preliminary copper bump 1300 making contact with the contact pad 1020 of the IC chip.

Particularly, when being undesirably provided over the volume of the first space S1 of the inner body 110, the electroplating solution S may be overflowed to the retrieving path 130 between the inner body 110 and the outer body 120. Then, the overflowed electroplating solution S may be retrieved to the mixer 410 through the second opening 122*a*.

Therefore, the electroplating solution S may be circulated between the solution provider 400 and the plating chamber 100 in the electroplating process.

When completing the preliminary copper bump 1300 on the IC chip, the IC chip may be separated from the conductive plate 310 and may be unloaded from the plating chamber 100 (S500). Thereafter, the IC chip may be transferred to a next process chamber in which a reflow process may be performed against the preliminary copper bump 1300.

Referring to FIG. 6, the mask pattern 1200 may be removed from the preliminary UBM layer 1070 by a strip process and then the IC chip may be instantaneously heated at a temperature slightly over a melting point of copper. That is, a reflow process may be performed on the preliminary copper bump 1300. Thus, the preliminary copper bump 1300 may be formed into a copper bump 1320 that may be shaped into a sphere and make contact with the contact pad 1020.

Figure 7:
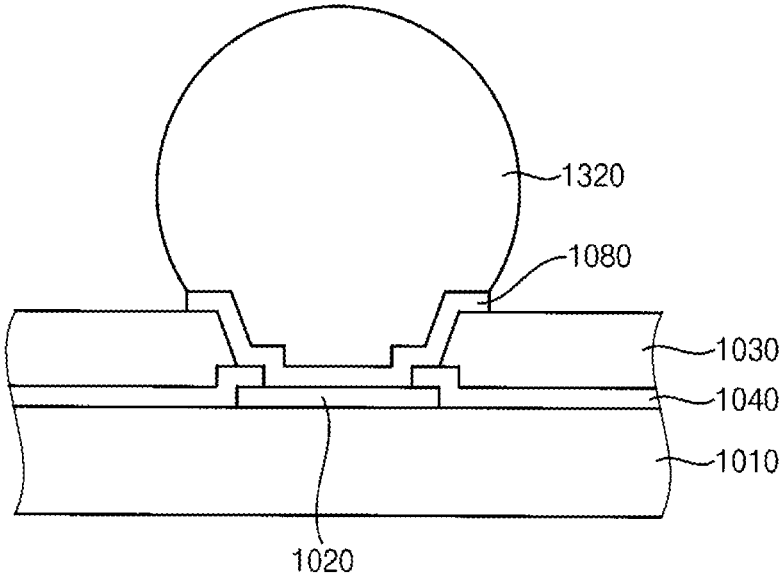

Referring to FIG. 7, the preliminary UBM layer 1070 may be removed from the IC chip by an etching process using the copper bump 1320 as an etching mask, thereby forming a UBM layer 1080 interposed between the copper bump 1320 and the contact pad 1020.

According to example embodiments of a method of forming the copper bump, the plating speed of the copper bump may be increased without deterioration of the surface flatness by an electroplating process using the copper electroplating solution having such a leveler that may include an N-vinyl pyrrolidone compound represented by Chemical Formula (2), a diallyldimethyl ammonium chloride (DADMAC) represented by Chemical Formula (3), a copolymer of DADMAC and N-vinyl pyrrolidone represented by Chemical Formula (4) and combinations thereof in which trivalent and/or quad-valent nitrogen (N) ions may be included. Accordingly, the process efficiency of the electroplating process for forming the copper bump may be sufficiently increased without deterioration of the surface flatness of the copper bump.

Copper electroplating solutions were prepared according to the following experimental example and the comparative example and the plating speed of the electroplating speed of the electroplating process using the respective experimental and comparative examples and the surface flatness of the copper bump formed by the electroplating process using the respective experimental and comparative examples.

Experimental Sample:

An aqueous electrolyte solution was prepared by using copper(II) sulfate pentahydrate ($CuSO_4.5H_2O$) in which about 60 g/L of copper (Cu), about 50 g/L of sulfuric acid ($H_2SO_4$) and about 50 g/L of hydrochloric acid (HCl) were dissolved. About 3 g/L of a disulfide compound was mixed in the aqueous electrolyte solution as the accelerator and about 0.75 g/L of a PEO-PPO-PEO tri-block copolymer was also mixed in the aqueous electrolyte solution as a suppressor. The above mixture of the accelerator and the suppressor in the aqueous electrolyte solution was sufficiently stirred and about 1.35 g/L of DADMAC copolymer having a weight average molecular weight of about 3,000 was added into the mixture of the accelerator and the suppressor in the aqueous electrolyte solution. Bis-(3-sulfo-3-methylpropyl) disulfide dipotassium salt (Me-SPS) was used as the disulfide compound.

Comparative Sample:

Comparative sample was prepared substantially by the same method as that of the experimental sample, except that about 1.35 g/L of arylated polyethyleneimine (PEI) having a weight average molecular weight of about 3,000 was added as the leveler.

An experimental copper bump and a comparative copper bump were formed on the same IC chip by the electroplating process using the above experimental sample and the comparative sample, respectively, as the copper electroplating solution. Particularly, the electrode pad of the IC chip was partially exposed through an opening defined by a silicon oxide pattern and a photoresist pattern on the silicon oxide pattern. A copper titanium nitride layer and a copper seed layer were sequentially formed on a sidewall and a bottom of the opening. The above IC chip having the copper titanium nitride layer and a copper seed layer was loaded into each of the plating chambers which used the experimental sample and the comparative sample, respectively, as the copper electroplating solution. The electroplating process was performed on the IC chip at a room temperature and the IC chip was rotated at a speed of about 30 rpm, to thereby form a copper bump on the IC chip at each electroplating process. In each of the electroplating processes, the current may be applied to the substrate holder of plating chamber in such a way that the charge density on the IC chip was about 21 $mA/cm^2$.

Figure 9:
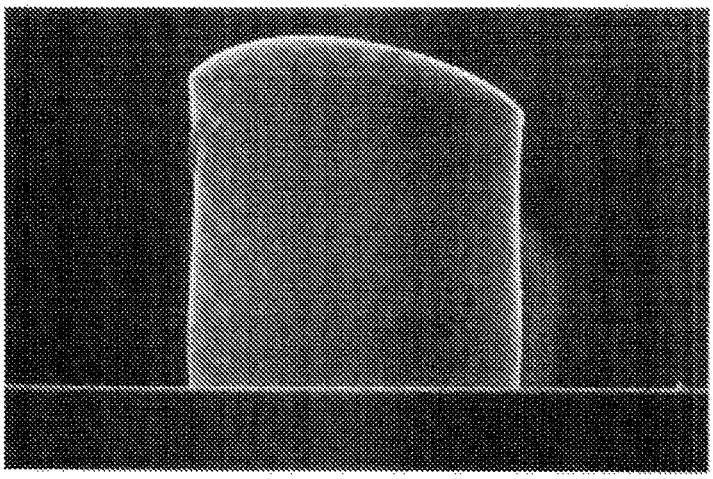
FIG. 9 is a scanning electron microscope (SEM) picture of the comparative copper bump formed by using the comparative sample as an electroplating solution.
Figure 10:
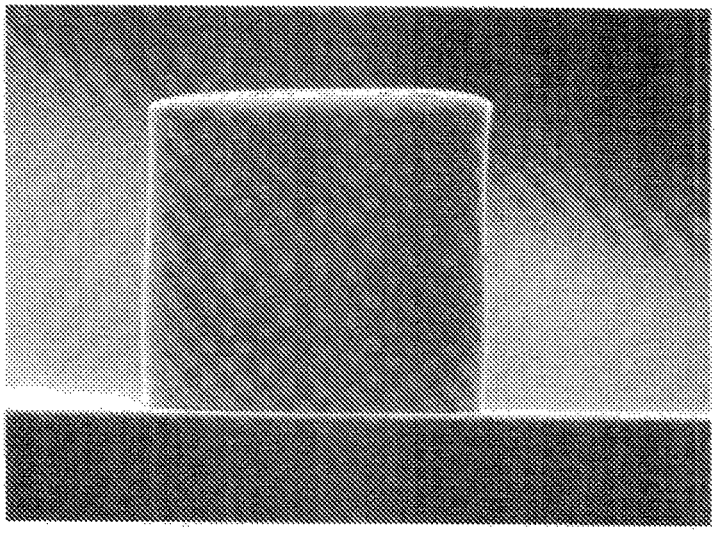
FIG. 10 is a SEM picture of the experimental copper bump formed by using the experimental sample as an electroplating solution.

FIG. 9 is a scanning electron microscope (SEM) picture of the comparative copper bump formed by using the comparative sample as an electroplating solution. FIG. 10 is a SEM picture of the experimental copper bump formed by using the experimental sample as an electroplating solution.

Referring to FIGS. 9 and 10, the surface flatness of the comparative copper bump was measured to be about 20% while that of the experimental copper bump was measured to be about 10% under the same charge density. In such a case, the electroplating speed of the comparative copper bump was measured to be about 4.7 μm/min while that of the experimental copper bump was measured to be about 5.0 μm/min.

That is, when DADMAC was used as the leveler of the electroplating solution in place of arylated PEI, the surface flatness of the copper bump was improved to a degree of about 50%, which results in preventing or inhibiting the local increase of the charge density at the relatively high current area of the IC chip due to the positive nitrogen ions dissolved from the DADMAC. Particularly, the above experimental results indicate that the surface flatness of the copper bump was improved together with the increase of the plating speed. That is, example embodiments of the copper electroplating solution may increase the copper plating speed of the electroplating process of forming the copper bump and may improve the surface flatness of the copper bump.

According to the example embodiments of the electroplating solution and the copper bump formed by using the electroplating solution, a copolymer from which nitrogen positive ions may be dissolved may be mixed with the aqueous electrolyte solution as the leveler of the electroplating solution. Thus, abnormal precipitation of copper may be sufficiently prevented or inhibited at a relatively high current area at which the charge density may be locally higher over an average charge density. Accordingly, the process efficiency of the electroplating process for forming the copper bump may be sufficiently increased without deterioration of the surface flatness of the copper bump, thereby increasing an overall electroplating process of the copper.

Example embodiments of the memory device may be applied to various electronic systems including semiconductor devices and IC chips, for example, telecommunication systems and storage systems.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concepts. Accordingly, all such modifications are intended to be included within the scope of the present inventive concepts as defined in the claims. In the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An electroplating solution comprising:

an aqueous electrolyte solution including water soluble copper salts, sulfide ions and chloride ions;

an accelerator including an organic material having sulfur (S), the accelerator accelerating copper (Cu) reduction;

a suppressor including a polyether compound, the suppressor selectively suppressing the copper reduction; and a leveler including at least one of an N-vinyl pyrrolidone compound represented by chemical formula (1) and a copolymer of diallyldimethyl ammonium chloride (DADMAC) and N-vinyl pyrrolidone represented by chemical formula (3) at a concentration of 0.1 g/L to 10 g/L in the electroplating solution, (1)

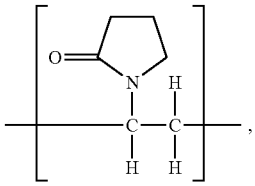

, and (3)

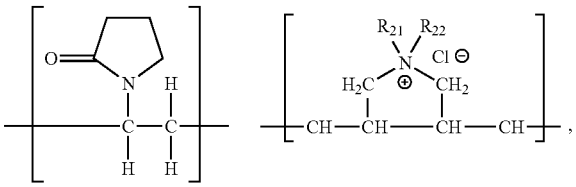

wherein each of $R_{21}$ and $R_{22}$ denote a $C_1$-$C_4$ unsubstituted alkyl group.

2. The electroplating solution of claim 1, wherein the aqueous electrolyte solution includes copper ions at a concentration of 10 g/L to 200 g/L, the sulfide ions at a concentration of 5 g/L to 50 g/L and the chloride ions at a concentration of 10 mg/L to 100 mg/L in the electroplating solution.

3. The electroplating solution of claim 1, wherein the leveler is a copolymer of the N-vinyl pyrrolidone compound represented by chemical formula (1) and the copolymer of DADMAC and N-vinyl pyrrolidone represented by chemical formula (3).

4. The electroplating solution of claim 1, wherein the accelerator includes a disulfide compound represented by chemical formula (4), (4)

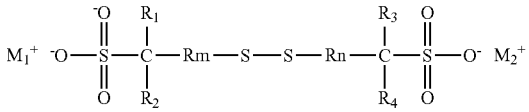

wherein each of $R_1$ and $R_3$ independently represent one of a methyl group, an ethyl group, a propyl group, an isopropyl group, an n-butyl group, a sec-butyl group, a tert-butyl group and a trimethylsilyl group, each of $R_2$ and $R_4$ independently represent one of hydrogen (H), a methyl group, an ethyl group, a propyl group, an n-butyl group, a sec-butyl group, a tert-butyl group and a trimethylsilyl group, each of Rm and Rn independently represent one of a $C_1$-$C_{10}$ alkylene, a $C_3$-$C_{10}$ cycloalkylene and a $C_4$-$C_{10}$ aromatic hydrocarbon, and each of $M_1^+$ and $M_2^+$ independently represent one of a proton, an alkali metal ion and an ammonium ion, and the polyether compound includes a tri-block copolymer of polyethyleneoxide (PEO)-polypropyleneoxide (PPO)-PEO having a weight average molecular weight of 300 to 10,000 and having an ethylene oxide content (EO %) of 1% to 99% (w/w).

5. An electroplating solution comprising:

an aqueous electrolyte solution including water soluble copper salts, sulfide ions and chloride ions; and a leveler including at least one of an N-vinyl pyrrolidone compound represented by chemical formula (1) and a copolymer of diallyldimethyl ammonium chloride (DADMAC) and N-vinyl pyrrolidone represented by chemical formula (3), (1)

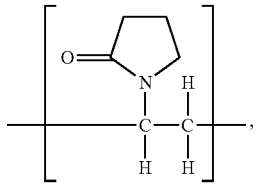

, and (3)

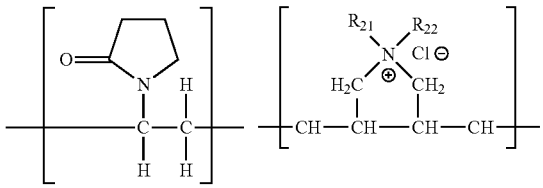

wherein each of $R_{21}$ and $R_{22}$ denote a $C_1$-$C_4$ unsubstituted alkyl group.

6. The electroplating solution of claim 5, wherein the aqueous electrolyte solution includes copper ions at a concentration of 10 g/L to 200 g/L, the sulfide ions at a concentration of 5 g/L to 50 g/L and the chloride ions at a concentration of 10 mg/L to 100 mg/L in the electroplating solution.

7. The electroplating solution of claim 5, wherein the leveler is a copolymer of the N-vinyl pyrrolidone compound represented by chemical formula (1) and the copolymer of DADMAC and N-vinyl pyrrolidone represented by chemical formula (3).

8. The electroplating solution of claim 5, further comprising:

an accelerator including a disulfide compound represented by chemical formula (4), (4)

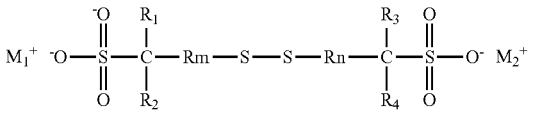

wherein each of $R_1$ and $R_3$ independently represent one of a methyl group, an ethyl group, a propyl group, an isopropyl group, an n-butyl group, a sec-butyl group, a tert-butyl group and a trimethylsilyl group, each of $R_2$ and $R_4$ independently represent one of hydrogen (H), a methyl group, an ethyl group, a propyl group, an n-butyl group, a sec-butyl group, a tert-butyl group and a trimethylsilyl group, each of Rm and Rn independently represent one of a $C_1$-$C_{10}$ alkylene, a $C_3$-$C_{10}$ cycloalkylene and a $C_4$-$C_{10}$ aromatic hydrocarbon, and each of $M_1^+$ and $M_2^+$ independently represent one of a proton, an alkali metal ion and an ammonium ion, and a suppressor including a tri-block copolymer of polyethyleneoxide (PEO)-polypropyleneoxide (PPO)-PEO having a weight average molecular weight of 300 to 10,000 and having an ethylene oxide content (EO %) of 1% to 99% (w/w).

9. The electroplating solution of claim 8, wherein the leveler is at a concentration of 0.1 g/L to 10 g/L in the electroplating solution, the accelerator is at a concentration of about 3 g/L to about 100 g/L in the electroplating solution, and the suppressor is at a concentration of about 10 g/L to about 500 g/L in the electroplating solution.

* * * * *